US006484323B1

(12) United States Patent
Pu

(10) Patent No.: US 6,484,323 B1
(45) Date of Patent: Nov. 26, 2002

(54) CONVERTIBLE-HAT WITH BRIM STOWABLE WITHIN CAP

(76) Inventor: Ly Pu, 3521 Milagros St., San Diego, CA (US) 92123

( * ) Notice: Subject to any disclaimer, the term of this patent is extended or adjusted under 35 U.S.C. 154(b) by 0 days.

(21) Appl. No.: 10/023,274

(22) Filed: Dec. 15, 2001

(51) Int. Cl.[7] ..... A42B 1/06

(52) U.S. Cl. ..... 2/410; 2/171.1; 2/195.1; 2/10; 2/181

(58) Field of Search ..... 2/10, 410, 171, 2/171.03, 171.1, 171.6, 182.2, 183, 181, 209.11, 209.12, 175.1, 175.2, 175.5, 175.6, 175.7, 195.1

(56) References Cited

U.S. PATENT DOCUMENTS

| | | | | | |
|---|---|---|---|---|---|
| 4,096,590 | A | | 6/1978 | Kesshock | 2/180 |
| 4,682,373 | A | | 7/1987 | Baran | 2/175 |
| 4,815,784 | A | | 3/1989 | Zheng | 296/97.7 |
| 4,999,851 | A | | 3/1991 | Hall | 2/180 |
| 5,101,516 | A | * | 4/1992 | Scarnato | 2/181 |
| 5,247,709 | A | | 9/1993 | Epply | 2/175.1 |
| 5,548,846 | A | * | 8/1996 | Bianchetti | 2/10 |
| 5,715,534 | A | * | 2/1998 | Mobley | 2/10 |
| 5,845,338 | A | * | 12/1998 | Clark | 2/171.1 |
| 5,857,219 | A | | 1/1999 | Edmark | 2/182.2 |
| 5,862,520 | A | | 1/1999 | Wyant | 2/10 |
| 5,862,523 | A | * | 1/1999 | Proctor | 2/171 |
| 5,875,493 | A | * | 3/1999 | MacDonald et al. | 2/10 |
| 5,950,241 | A | | 9/1999 | Gomez | 2/172 |
| 6,018,821 | A | | 2/2000 | Adams | 2/209.11 |
| 6,070,270 | A | * | 6/2000 | De La Torre | 2/10 |
| 6,131,201 | A | * | 10/2000 | Chu | 2/172 |

OTHER PUBLICATIONS

Applicant's Own USPTO/Disclosure–document . . . —Filed on: Apr. 24, 2001, #492830, (copy included herewith).

* cited by examiner

*Primary Examiner*—Gary L. Welch
(74) *Attorney, Agent, or Firm*—Inventech

(57) ABSTRACT

An inexpensive multi-modality utility hat of non/gender-specific design, having advantageous features providing its user with the novel convenience of readily transforming into several different types of hats in one. For example, the brim portion can be quickly and easily detatched from its central cap portion via a zipper, enabling user to wear only either the cap or the brim separately if desired; -and, if the cap portion only is selected to be worn for a time, the brim twist/tripple-folds into a compact member which concealably stows within an integral-pocket portion of the cap. The cap portion includes an adjustable-cord compliance feature enabling one size to fit all, and may be optionally fitted with a broad or a narrow brim of circular, triangular, or squared motif: -and brim-width may be altered at front or sides via a simple gathering provision. Alternately, my light-weight compact hat can be carried fiat within a backpack.

20 Claims, 2 Drawing Sheets

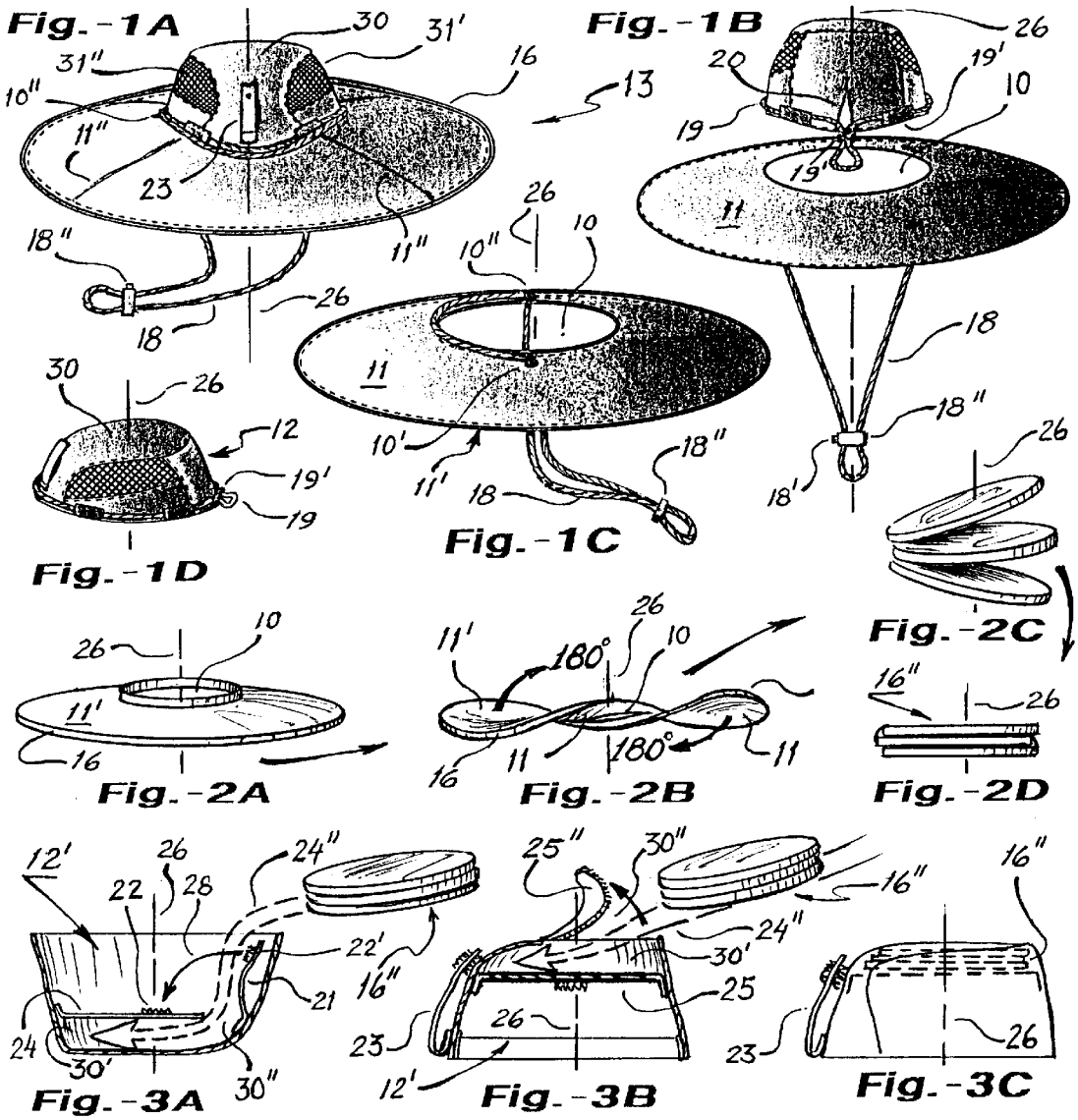
Fig.-1A
Fig.-1B
Fig.-1C
Fig.-1D
Fig.-2A
Fig.-2B
Fig.-2C
Fig.-2D
Fig.-3A
Fig.-3B
Fig.-3C
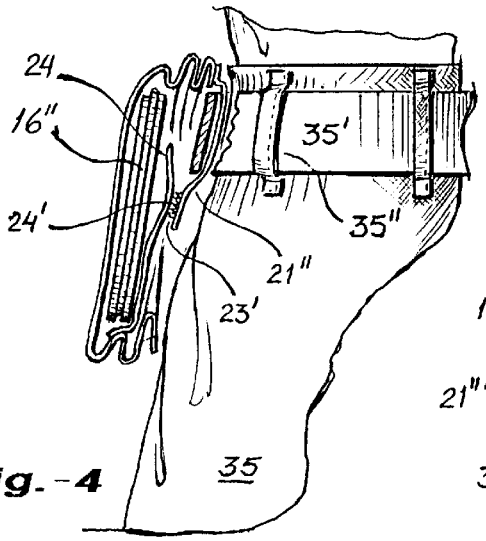
Fig.-4
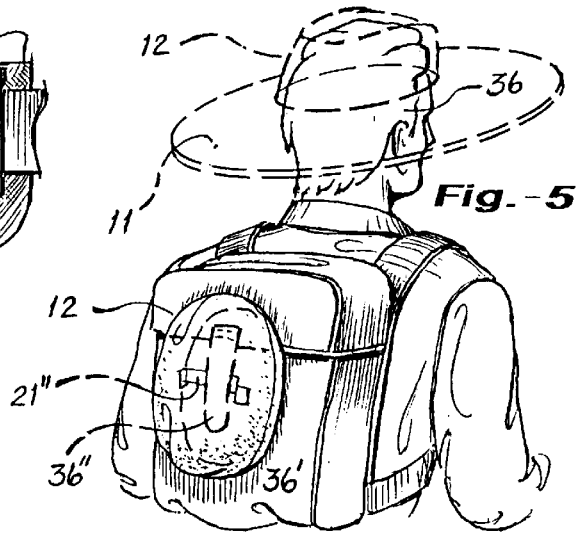
Fig.-5

CONVERTIBLE-HAT WITH BRIM STOWABLE WITHIN CAP

I.) BACKGROUND OF THE INVENTION

1. Field of Invention

This invention relates to brimmed hats, and more specifically it relates to those types of headgear facilitating convenient removal and compactly folded stowing of the brim portion according to requirements of ones daily activities.

2. Relevant Prior-Art

Background research discovery provides some prior patent-art regarded as germane to this disclosure, chronologically for example U.S. Pat. No. 4,096,590 (filed: June 1976) contemplates a very broadly brimmed hat visually somewhat emulating both the early-west style wherein the brim is upturned slightly front/rear in combination with complementary drooping left/right continuous brim portions; or conversely, the hat can be worn rotated 90-degrees upon ones head, to create more of a Spanish/gaucho-style motif (thus the brim in this instance appearing to droop-down somewhat front/rear, while presenting a slightly upturned continuous formation along left/right sides). The brim is not detachable from the central cap portion, and the perimeter of the brim includes a vertical metal band sewn into the brim's rim. The hat's brim thus is foldable figure-8 fashion ultimately into half-size so as to then be carried in a flat-circular zippered carrybag having an external convenience-pouch.

In U.S. Pat. No. 4,682,373(filed: August 1982) is shown a compact pocket-cap having only a modest brim portion, and which is collapsed-flat and then rolled into a somewhat conical shape, then held to that compacted condition via an auxiliary-strap member.

In U.S. Pat. No. 4,815,784(filed: February 1988) is shown a popular automotive-windshield to sunshield, comprised of two closely spaced-apart metal-hoops contained within a sewn-fabric envelope which can be made compact for more convenient stowing. The thin assembly can be readily folded in-half, then owing the flexibility of the hoops, is folded into the figure-8 shape, to finally become substantially circular and about ¼th the size of the original elongated panel; hence much more readily and conveniently stowed.

In U.S. Pat. No. 4,999,851(filed: August 1989) is shown a compactable hat which normally features a modest brim portion extending radially from the base of a substantially cylindrical cap portion having a slightly recessed flat top portion; a piano-wire member being sewn into the rim of the circular brim. The wire-rim insert is formed circular with its opposed-ends being permanently jointed together, so as to be rotatable relative to each other. Hence, the hat can be twisted into a figure-8 shape and finally into a half-sized circular configuration whereby the central cap portion generally collapses into itself; thereby enabling the hat to be conveniently pocketed.

In U.S. Pat. No. 5,247,709(filed: March 1993) is shown a folding paper-hat constructed somewhat like a paperbag, although appearing substantially like a country-gentleman's hat; the modest brim becomes folded downward and the entire hat folded-flat like an unused paperbag, so as to fit into one's coat-pocket.

In U.S. Pat. No. 5,862,520(filed: August 1997) is shown a baseball like sportcap with frontal/visor-bill and rear-adjustable sizing-band, wherein is also included an attachable/detachable brim member; the user is thus enabled to adapt their broad-brimmed member to the sportcap by inserting the bill. into a pocket like receptacle sewn into the brim frontally, then the sportcap's headband is loosened and threaded through slots provided at the rear of the special brim-member, and re-secured thereby completing attachment of the brim to the sportcap.

In U.S. Pat. No. 5,857,219(filed: April 1997) is shown another figure-8 type (although the inventor claims a tripple/circular-fold procedure) folding-hat having special built-in foam-finger like appendages beneath the central cap or crown portion, that are said to obviate the causing of messing a lady's hair-coiffeur. The rim of the brim portion having a permanent encircling flat-radial or round wire or plastic insert.

In U.S. Pat. No. 5,950,241(filed: June 1998) is shown another hat with a figure-8 type twist-folding brim, with the additional feature of an aftward deployable sun-drape member which is retracted upward against the underside of the broad-brim via a gathering pull-cord arrangement.

In U.S. Pat. No. 6,018,821(filed: January 1999) is shown a hat apparel of non-separable construction which is convertible from a brimmed-hat into either of two styles of turban-hats.

Therefore, in full consideration of the preceding patent review, there is determined a need for an improved form of device to which these patents have been largely addressed. The instant inventor hereof believes their newly improved brimmed-hat apparel, I commercially refer to as the ADVENTURE-Hat ™, currently being developed for production under auspices of the LYHAT-Mfg./Mkt.Co. ("Lyhat" being pronounced "le-hat, thereby connoting a French air-of-fashion"), exhibits certain advantages as shall be revealed in the subsequent portion of this instant disclosure.

II.) SUMMARY OF THE INVENTION

A.) In view of the foregoing discussion about the earlier invention art, it is therefore important to make it pellucid to others interested in the art, that the object of this invention is to provide a novel preferably non-gender specific two-piece hat structure, characterized as embodying a light-weight central cap (or so called crown) portion which can generally be worn alone during both the earlier and latter hours of one's day. A matching companion brim portion is preferably made readily available from within a stow-pocket generally concealed within the upper-underside region of the generally skull-cap like central-cap portion; -enabling the brim to be easily retrieved and instantly self-unfolding from its preferred well known figure-8 type albeit dual-twisted/tripple-folded flat stowed condition (hence, defining a substantially flat and generally circular annular-panel), and having a donning-aperture in its center (prior to tripple folding). This novel configuration therefore facilitating a maximum of utility-value, owing that the user can advantageously wear just: a.) the cap portion (sans-brim), b.) wear just the brim portion(their head thus being exposed centrally), or, c.) wear the assembled two portions. Hence, the annular brim can be optionally attached or detatched relative to the cap, via either conventional (commercially available) avusable hook-&-loop type (such as well known Velcro®-brand) fastener; or, via conventional (commercially available) linear-zipper type fastener having a sliding-staple with gripper-tang (either of individual interlocking-cleated type, or of the ZipLock® type extruded-plastic zipper configuration).

B.) Another object of my invention disclosure is to set forth a convertible-hat item of apparel according to preceding item-A, wherein I also set forth the notion of a convertible-hat adaptable to brims of various diameters (a broad-brim being characterized as measuring approximately 8–10 inches radially outboard of the central cap, a medium-brim being about 5–8 inches, and a small-brim being about 2–5 inches); as well as differently shaped brims, such as a visor-brim extending either predominantly forward or predominantly aftward to respectively protect either one's face or neck from harsh sun for example. Although the brim (hereinafter referred to as the peripheral-brim) is said in item-A to be "substantially planar", it actually preferable employs a slight so called "gravity-droop" appearance; which is achieved by employing a continuous circular resilient-band member permanently located within the outermost perimeter region of the preferably double-layered sewn-fabric construction of the peripheral-brim member. If the rim of the peripheral-brim were pushed-in radially by impingement against a fixed object, once relieved of the impinging force, the resilient-band is characterized as maintaining an instant spring-back action, -restoring the rim into a normally circular configuration as viewed from above. To provide the desired characteristic brim shape, the resilient-band is made from a metal or plastic material of approximately ¼-inch flat/cross-sectional shape, which is captively installed within the outermost rim region of the peripheral-brim with its broad-surface oriented vertically. Additionally, the peripheral-brim is preferably pieced together from three to six substantially pie-shaped sections (each possessing slightly greater surface-area than an equivalent pie-portion presented by a one-piece flat-pattern), the excess material thereby enabling the peripheral-brim to exhibit its preferred slight overall gravity-droop appearance (whether attached to the central-cap portion or unzipped therefrom for use independently). While my double-layered brim construction is preferred, a single-layer construction will suffice, as will a more conventional sewn-on U-shaped perimeter-edging to similarly position my resilient-band.

C.) Another object of this invention disclosure is to set forth a convertible-hat item of apparel according to preceding items-A&B, wherein is also set forth a one-size-fits-all crown or cap portion, employing a special universally-adjustable hat-band construction. To facilitate it fitting all wearers, my hat-band features exteriorly thereto a proximal series of radial retention-loops (or a single continuous tunnel-like retention-loop, having opposed inlet and outlet terminuses), through which is threaded a circumferential shoelace like pull-cord; thereby enabling that one size of cap-crown member can virtually fit any wearer. The pull-cord includes a conventional commercially available sliding-clasp, capable of selectively locking to that precise circumferential-length required by the wearer.

Also included in in the sidewall of the hat is a pair of laterally right and left opposed air-circulation cross-flow vent-panels made of a fabric-mesh type of grille (in some cases made to a color which preferably blends concealingly with the surrounding cap-material). These grilles are elevated just above an encircling hat-band portion, the hat-band (conventionally of soft fabric or leather) serving its traditional function of affording a more comfortable resting of the hat upon the wearer's head just above one's ears.

III.) DESCRIPTION OF THE PREFERRED EMBODIMENT DRAWINGS

The foregoing and still other objects of this invention will become fully apparent, along with various advantages and features of novelty residing in the present embodiments, from study of the following description of the variant generic species embodiments and study of the ensuing description of these embodiments. Wherein indicia of reference are shown to match related matter stated in the text, as well as the claims section annexed hereto; and accordingly, a better understanding of the invention and the variant uses is intended, by reference to the drawings, which are considered as primarily exemplary and not to be therefore construed as restrictive in nature; wherein:

FIG. 1A, is a pictorial-view favoring the upper-frontal aspect of my exemplified convertible-hat assembly having two major component parts, the upper central-cap part shown here fully joined with the lower peripheral-brim part;

FIG. 1B, is a second-sequence view thereof, wherein my exemplified hat has been rotated 180-degrees upon its imaginary vertical-axis of reference to thereby expose its upper-rear aspect, whereto the two major component parts are here shown vertically separated;

FIG. 1C, is a third-sequence view thereof, wherein the separated peripheral-brim portion only of my exemplified convertible-hat, has been rotated another 90-degrees to expose its upper/side-elevation aspect;

FIG. 1D, is a forth-sequence view thereof, wherein the separated central-cap portion only of my exemplified convertible-hat, has also been rotated another 90-degrees to expose its upper/side-elevation aspect;

FIG. 2A, is an upper/side-elevation aspect of my separated peripheral-brim member, demonstrating in five progressional sequences how my hat can be collapsed from its natural annular shape into an uncreased albeit compactly reduced package;

FIG. 2B, is the second-sequence thereof, showing how the peripheral-brim becomes initially twisted via simultaneously applied 180-degree wrist-motion of user's opposed right and left hands;

FIG. 2C, is a third-sequence progression thereof, showing resultant contiguously tiered hoop like portions;

FIG. 2D, is a forth-sequence progression, showing the hoop like portions finally brought intimately into a flatly collapsed circular package;

FIG. 3A, is an inverted (bottom-up) semi-diagrammatic left/side-elevation longitudinal/cross-sectional view of my central-cap embodiment-A, revealing how the once twist-folded package of FIG. 2D can be stowed internally into an optional pocket like stow-compartment integrated into the crown region of this iteration;

FIG. 3B, is an upright semi-diagrammatic left/side-elevation longitudinal/cross-sectional view of my central-cap embodiment-B(top-opening), also revealing how the once twist-folded package of FIG. 2D can be stowed internally into an alternate optional stow-compartment integrated into the crown region of this iteration;

FIG. 3C, is an upright semi-diagrammatic left/side-elevation cross-sectional view, showing the final appearance of my general central-cap iterations, with the peripheral-brim thus concealed in phantom-outline there within;

FIG. 4, is a slightly enlarged longitudinal/cross-section, showing how my central-cap part can be conveniently employed in an optional toted-modality, conveniently attached to user's existing hip-belt;

FIG. 5, is a right-rear pictorial-view of an exemplified user supporting an existing backpack, to which is shown attached my compacted convertible-hat;

IV.) ITEMIZED NOMENCLATURE REFERENCES

10.10'/10"—donning-aperture, tie-down ports (left/right)

Figures 6A, 6B, 7A, 7B, 7C, 8, 9, 10A, 10B:
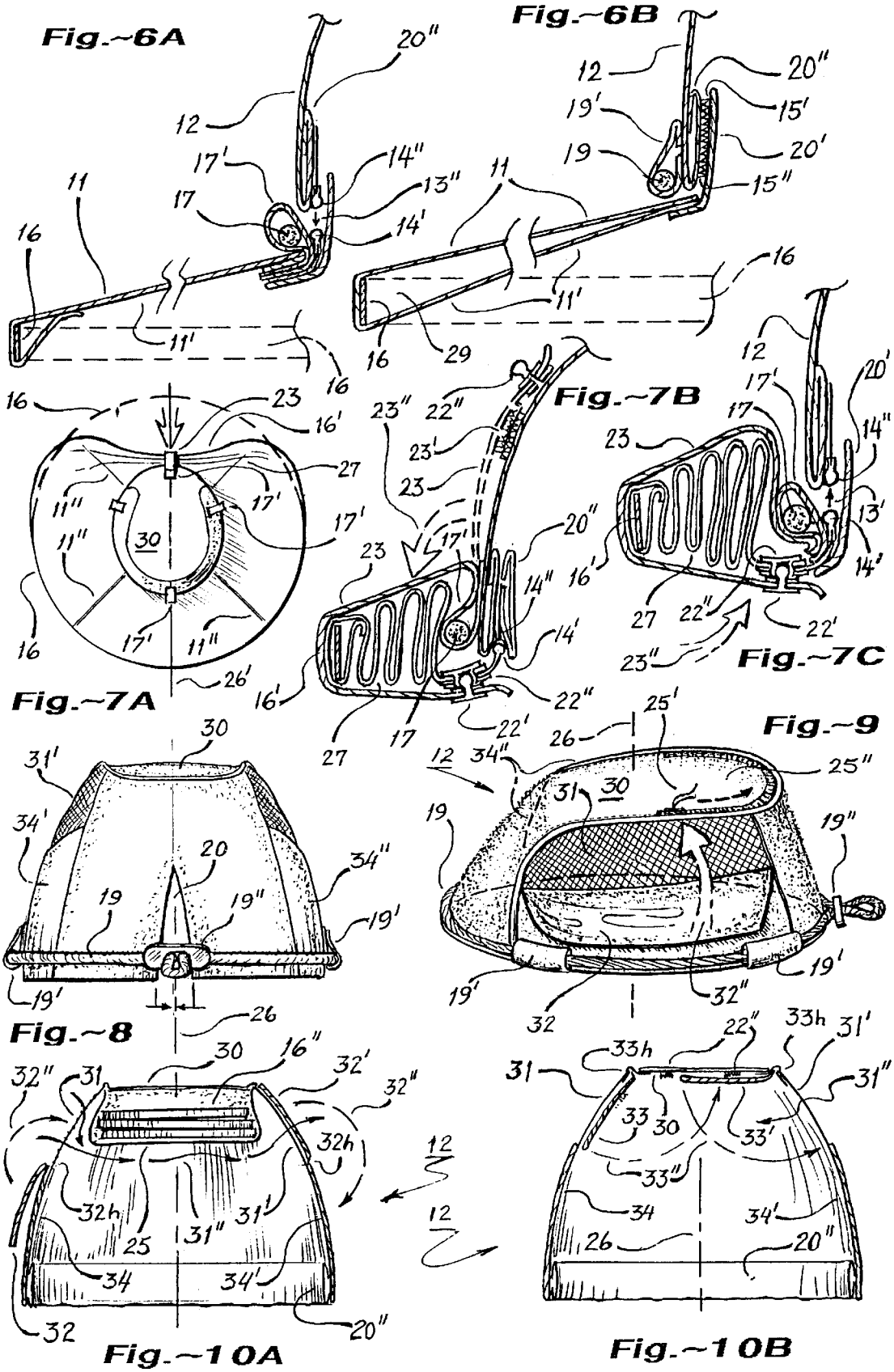
FIG. 6A, is the first of two sequence views revealing an enlarged partial radial/cross-sectional elevation-view FIG. 1B. showing the preferred arrangement of attachment points between the two major hat cap and brim components, here exhibiting a conventional detachable zipper type linear-fastener.
FIG. 6B, is the second of the two radial/cross-sectional elevation-view sequences, here showing how the two primary components (cap and brim) appear when attached substantially according to the assembly of FIG. 1A, although this iteration is employing a hook-&-loop type linear-fastener.
FIG. 7A, is the first of three companion views, here an upper/plan-view showing both how the surface-area of the circular peripheral-brim is preferably formed from plural pie-cut sections (lending a slight inherent gravity-drape), and also how the brim can preferably be radially-gathered (as to thereby facilitate an improved view by its wearer)
FIG. 7B, is the second view thereof here a left-side/elevation-view showing a central longitudinal cross-section of the combined peripheral-brim and central-cap implementation.
FIG. 7C, is an alternate third generic-variant view thereof, here a like longitudinal cross-section showing how the brim gathering can be achieved when the central-cap member is not being worn in combination.
FIG. 8, is a rear/elevation-view showing how my central-cap portion can optionally be constructed with a vertically-split head-sizing provision.
FIG. 9, is an upper-oblique left-side/elevation-view showing my central-cap, revealing the preferred arrangement of my ventilation-grill and circumferential adjustment-cord.
FIG. 10A, is a semi-diagrammatic central transverse cross-sectional view, showing how my optional external ventilation grill-flaps operate.
FIG. 10B, is showing an internally arranged generic-variant thereof.

11,11',11"—peripheral-brim member (top side, under side, pie-section joining-seams)

12,12'—central-cap member (outer-surface, inner-surface)

13,13',13"—united hat assembly, separation action ref.-arrow, joining action ref.-arrow

14'/14"—linear-fastener of zipper-type (brim-integrated part/hat-integrated part)

15'/15"—linear-fastener of hook-&-loop type (brim-integrated part/hat-integrated part)

16/16'/16"—resilient-band (natural condition/deflected condition/folded condition

17,17',17"—aperture sizing-cord on brim, cord-stay, slide-lock

18,18',18"—chin-strap, strap-stay, slide-lock

19,19',19"—circumferential sizing-cord on cap, cord-stay, slide-lock

20,20'/20"—head-band adj.-split, head-band (integral to brim/integral to cap)

21,21',21"—utility retention-strap (opened, affixed to close pocket, affixed to hang cap)

22/22',22"—retention-snap (male-portion/female-portion), hook-&-loop fasteners

23,23',23"—brim gathering stay-strap, attachment-point, strap wrap-around ref.-arrow

24,24',24"—stow-pocket panel, hook-&-loop type fastener, stowing-action ref.-arrow

25,25',25"—stow-pocket compartment-panel, half-circle zipper, half-circle access-flap

26,26'—general vertical-axis of reference, longitudinal ref.-line

27—gathered modality of peripheral-brim

28—action ref.arrow for retention-strap (item- 21)

29—interstitial-space (between layers of peripheral-brim)

30,30',30"—crown (top outer-surface), stow-compartment, compartment-mouth

31/31',31"—ventilation-grill (left-grill/right-grill), air-flow action ref.-arrows

32/32',32",32*h*—external grill-flaps (left-flap/right-flap), hinging ref.-arrow, hinging-point

33/33',33",33*h*—internal grill-flaps (left-flap/right-flap), hinging ref.-arrow, hinging-point

34/34',34"—cap sidewalls (left-sidewall/right-sidewall), optional seam-welting.

35,35',35"—existing user's pants, belt, belt-loops

36,36',36"—exemplified user person, existing backpack, exemplified pocket-strap

V.) DETAILED DESCRIPTION OF THE PREFERRED EMBODIMENTS

Initial reference is given by way of sequential FIG'S. 1/A,B,C,D, wherein is exhibited three optional modalities of my convertible-hat head-apparel, FIG. 1A being the assembled result of combining the two modalities of FIG. 1B, by joining both the central-cap 12 and attached peripheral-brim 11; while FIG. 1C shows my peripheral-brim portion 11 alone, and FIG. 1D is showing my central-cap portion 12 alone. Thus in aggregate FIG'S. 1/A/B/C, is set forth those basic features which I consider important to understanding of my novel so-called adventure-hat construction, which make my convertible-hat a truly practical item of apparel, both as a type of practical headgear protecting its wearer from the sun and rain while working, as well as providing a form of headgear capable of making a significant fashion statement for its wearer.

In FIG. 1A front-view for example, while my hat appears fairly conventional and completely united as an "adventure-hat" type of style, the example of FIG. 1B shows that the user can separate the central-cap portion 12 from the peripheral-brim portion 11, so that my hat can be then either worn only for its shading advantage (and also without disturbing user's hair-coiffeur), or alternately in FIG. 1D as more of a large skull-cap serving to protect the upper half of wearer's head. Note also that my uniquely convertible adventure-hat also preferably includes a pair of laterally-opposed cooperative air/venting-grilles 31 and 31', -details of which are addressed further on herein.

Also shown in FIG'S. 1A/B/C is a preferred type of chin-strap 18, having a conventional commercially available selectively-adjustable sliding strap-stay 18' (preferably employing a currently popular commercially available guillotine-type friction clasp), whereby simply depressing of its spring biased (normally-closed) slide-lock 18" opens the guillotine/pinch-hole (unshown) enabling user to readily slide the strap-stay 18' along contiguous cord portions 18 to lengthen(loosen) or shorten(tighten) it beneath a wearer's chin. The uppermost portion of the chin-strap is preferably secured through the peripheral-brim at points 10' and 10", thereby serving to reliably secure the peripheral-brim 11 upon wearer's head during windy conditions. The donning-aperture 10 of the peripheral-brim is thus merely placed down around the wearer's head, to a point whereby the peripheral-brim is resting comfortably just above one's ears; plus, it is also preferred that the perimeter of the peripheral-brim include a continuous resilient-band 16 having an inherent spring-back characteristic when momentarily deformed from its natural circular formation. A cross-sectional detail of how this resilient-band is integrated with the peripheral-brim 11 is revealed in FIG'S. 6 & 7; first however, reference to sequential FIG'S. 2A/B/C/D serves to demonstrate how my peripheral-brim 11 can be held in one's opposed-hands and instantly twisted (per FIG. 2B) by simple application of wrist articulation into a triad tiered condition of FIG. 2C, which ultimately transcends into a compact flat configuration 16" according to FIG. 2D.

Once so collapsed, my folded 16" peripheral-brim can then preferably be conveniently stowed uniquely within the concealing confines of the central-cap's crown 30, as is demonstrated in FIG.'S. 3A/B/C. In FIG. 3A for example, is shown how my central-cap can in one preferred iteration be simply inverted twisted-over 360-degrees (by simultaneous 180-degree twist of right and left wrists) and readily delivered down into the compartment 30' created between crown 30 and a spaced apart stow-pocket panel 24 sewn to the inside surface 12' forming the central-cap's sidewall. A simple utility retention-strap 21 (also secured to the inside surface 12') is then manually closed over the stow-pocket panel compartment-mouth 30", preferably via conventional cooperative snap-fasteners (or effectively equivalent hook-&-loop fasteners) 22 on to receiving portion 22' according to action ref.-arrow 28. Alternatively, the stow-compartment 30' is formed by a full compartment-panel member 25, while access therein is gained via provision of a semi-circular access-flap 25" having a narrow half-circle zipper thereto (also clearly shown in FIG. 9); thereby enabling the user to manually place the folded peripheral-brim 16" therein and reclose the slider-clasp of zipper 25'. In final FIG. 3C is shown how in either generic-variation embodiment FIG. 3A of FIG. 3B, the peripheral-brim 16" can be totally concealed beneath the crown 30 of my central-cap.

There remain subtle, however vital other differences which are to become herein more evident and understood as important improvements. For example, FIG. 4 shows how my central-cap 12 replete with stowed peripheral-brim 16" can also be carried anywhere at the ready as a further tote-modality of nonusage as it were, by engaging the utility retention-strap 21" around the user's existing conventional waist-belt 35' where it is preferably secured via a conventional hook-&-loop fastener or conventional male/female retention-snap arrangement 22". Similarly, in FIG. 5 is shown a person 36 carrying a conventional fabric back-pack 36' having an exemplified pocket-strap 36" serving to hold the compartment-cover in its normally-closed position: while here the user of my hat assembly 13 is shown having removed the hat assembly and having collapsed the hat into the condition depicted in FIG. 3C. Thus. with the hat so collapsed, the user can conveniently hang the hat from the existing pocket-strap 36" by simply looping the utility retention-strap 21" around the pocket-strap 36", where it is easily carried until the hat is needed to be donned once again.

Reference to FIGS. 6A/B shows the preferred manner by which my central-cap 12 having a base-perimeter portion comprised of an integral head-band 20" is joined with the peripheral-brim 11, the example of FIG. 6A employing a conventional zipper type linear-fastener comprised of the brim-integrated zipper portion 14' and its separably interlocking like cap-integrated zipper portion 14". The example of FIG. 6B shows how the brim and cap portions appear assembled, but is a generic-variant embodiment which employs a linear-fastener of the hook-&-loop type 15' and 15", regarded in this disclosure usage as equivalent or tantamount to the alternate cleated zipper type.

Also notable is the particular construction of the peripheral-brim 11 alternatives of FIGS. 6A/B, which in FIG. 6A is preferably formed from one fabric-layer or two joined layers of fabric, which is terminated at the outer-perimeter by wrap-around of the resilient-band 16, where the terminus of the fabric is preferably sewn as to thereby envelope the resilient-band 16. In the alternate embodiment of FIG. 6B, is shown the peripheral-brim 11 constructed to retains the resilient-band 16 in a manner which envelopingly creates an interstitial-space 29 between layers 11 and 11' of the fabric comprising the peripheral-brim.

In FIGS. 7A/B/C is shown how my continuous circular resilient-band device 16 can be conveniently deformed to facilitate optional usage (with or without the central-cap portion 12) in a retractably radially-gathered manner by its wearer; -as to thereby attain improved overhead viewing, or to let sunshine to thereby cast upon the wearer's face if desired. For example, the plan-view of FIG. 7A shows how the forward projecting portion of the peripheral-brim is manually collapsed radially inwardly from its natural circular condition 16 into the deflected condition 16'; while the normally smoothly deployed brim surface 11 is thus caused to become passively gathered 27. The gathered fabric 27 is kept in place via my brim-gathering stay-strap 23, the likes of which can be similarly included at different azimuth points around the peripheral-brim thereby obviating user having to skew or twist the hat from its necessarily fixed orientation along longitudinal-line of reference 26' (for example in the case of currently popular baseball-caps not having advantage of a continuous brim portion, wearers are oft seen donning their cap with the duck-bill visor twisted around to the rear in a somewhat goofy looking manner, and moreover whereas if turning the visor to one side as to gain localized shading, -it makes its wearer look even sillier!), and can actually be formed in combination with the cord-stays 17' which are also apparent in FIG. 7A. The companion views of FIGS. 7B/C are enlarged cross-sectional views taken along a central longitudinal-cut proximal what would be the forehead region of the wearer, and in FIG. 7B it can be better understood how the peripheral-brim 11 appears as locally gathered and held in place by the brim gathering stay-strap 23, which is shown to be preferably formed as an extension of the optional cord-stay 17'. Note also, how the central-cap can include a cooperative pair of hook-&-loop 22" fasteners by which to hold the stay-strap 23 when it is not deployed to gather the peripheral-brim 11. The embodiment of FIG. 7C shows details of the gathered peripheral-brim 27 and the relationship of the radially inwardly deflected resilient-band 16' member, all of which are shown being retained via the wraparound brim gathering stay-strap 23 which connects via a male/retention-snap device 22 (located upon the distal end of the stay-strap 23) to a female retention-snap 22' located upon the inboard underside 11' of the peripheral-brim. In FIG. 7C it can also be seen how this brim gathering feature can be employed without presence of the central-cap member 12, which is here shown detached from the peripheral-brim member 11. The preferred method of fabricating the peripheral-brim 11 in plural pie-sectors via provision of contiguous sewn-seams 11" which allow an extra amount of fabric to be provided into the brim, thereby serving to facilitate a desired gravity-droop to the entire peripheral-brim 11.

Next, in FIG. 8 is shown the rear-view aspect of my central-cap, revealing how the circumferential sizing-cord 19 can be employed in cooperation with an aftward head-band adjustor-split device 20 while manually adjusting the circumferential length of the sizing-cord 19 to the wearer's head-size by gentle sliding of the slide-lock 19", which is further revealed in FIG. 9.

Further reference to FIG. 9 also reveals certain other details of the central-cap 12, for example the preferred arrangement of the peripheral-brim's stow-pocket half-circle access-flap 25", and its cooperative half-circle zipper type linear-fastener 25' as was earlier depicted in FIG. 3B. Additionally, a ventilation-grille 31 is shown along with its exemplified optional external/grille-flap 32 and flap action ref.-arrow 32".

Study of FIGS. 10A/B shows a transverse central cross-section of my central-cap member 12 wherein is included my optional stow-compartment 25 forming the stow-compartment 30'; the stow-compartment fabric here shown suspended down from the cap's crown region 30, thereby enabling ambient-air to cross-flow 31" efficiently through preferably laterally arranged upwardly positioned ventilation-grills 31 and 31'. The left external grill-flap 32 is shown downwardly opened along the linear hinge-point 32*h* according to action/ref.-arrow 32", while the right external grill-flap 32' is shown closed intimately against the right-side ventilation-grill 31'. The generic-variant exhibit of FIG. 10B shows via ref.-arrowing 33" how my similar grill-flaps 33 are operated to close either intimately against the inside of the ventilation-grill 31 or 31'; or alternately, can be manually retracted upwardly to proximal the underside of the cap' crown 30 (via upper hinging-points 33*h*), where they are held via a pair of male/female-snaps or equivalent exemplified hook-&-loop fasteners 22".

Thus, it is readily understood how the preferred and generic-variant embodiments of this invention contemplate performing functions in a novel way not heretofore available nor realized. It is implicit that the utility of the foregoing adaptations of this invention are not necessarily dependent upon any prevailing invention patent; and, while the present invention has been well described hereinbefore by way of certain illustrated embodiments, it is to be expected that various changes, alterations, rearrangements, and obvious modifications may be resorted to by those skilled in the art to which it relates, without substantially departing from the implied spirit and scope of the instant invention. Therefore, the invention has been disclosed herein by way of example, and not as imposed limitation, while the appended claims set out the scope of the invention sought, and are to be construed as broadly as the terminology therein employed permits, reckoning that the invention verily comprehends every use of which it is susceptible. Accordingly, the embodiments of the invention in which an exclusive property or proprietary privilege is claimed, are defined as follows.

What is claimed of proprietary inventive origin is:

1. A non/gender-specific three-way hat convertible into independent modalities of usage; said hat comprising:

a first-modality central-cap means for entirely covering top of wearer's head without shading wearer's face or neck, the base-perimeter portion thereof comprising a circumferential headband with circular 1st/linear-fastener attachment means;

a second-modality peripheral-brim means having a central donning-aperture as to thereby radially extend outward entirely around wearer's head and thereby shade wearer's face and neck, and including a circular 2nd/linear-fastener attachment means, plus provision of a gathering-stay means by which to locally retract said peripheral-brim at the front, rear, and either side, thereby uniquely enabling wearer to selectively alter shading of said peripheral-brim in a azimuth manner while maintaining fixed longitudinal fore/aft orientation of said peripheral-brim;

a third-modality assembly, whereby both said first-modality central-cap means and said second-modality peripheral-brim means are combined via engagement of their respective said 1st and 2nd linear-fastener attachment means, thereby forming a unitized and ostensibly conventional appearing complete brimmed-hat assembly when so desired.

2. The three-way hat apparel apparatus according to claim 1, wherein said central-cap includes a manually operated primary/pull-cord means arranged proximal said head-band for universal head-size adjustment; said pull-cord including a conventional pull-stay means, and said central-cap also including one or more retention-loop means by which to positively maintain alignment of said pull-cord threading there through, plus a contiguous rear primary/adjustment-gap means.

3. The three-way hat apparel apparatus according to claim 2, wherein said pull-cord includes a sliding-clasp having sufficient inherent sliding-friction as to automatically maintain the precise said circumferential sizing adjustment manually selected by hat wearer.

4. The three-way hat apparel apparatus according to claim 1, wherein said central-cap includes an opposed pair of screen-mesh air-vents arranged immediately above said hat-band, thereby facilitation a cross-flow of ventilating ambient-air.

5. The three-way hat apparel apparatus according to claim 4, wherein said hat air-vents each have a said screen-mesh portion including a substantially imperferate flexile flap-panel which is openable along one permanently sewn attached edge, and including a manually releasable closure-retention means at extreme opposite edge of said flap-panel; thereby enabling hat wearer to selectively open or close said air-vents according to environmental conditions.

6. The three-way hat apparatus according to claim 1, wherein said central-cap includes a stow-pocket arranged beneath upper-surface side thereof, thereby not interfering with said circumferential sizing of said central-cap yet facilitating convenient stowing of folded said peripheral-brim portion when not deployed in said second-modality or said third-modality usage.

7. The three-way hat apparatus according to claim 1, wherein said 1st/linear-fastener means and cooperating said 2nd/linear-fastener means are tantamount to a conventional cleated-type zipper having a coacting pull-cleat and dependent pull-tang.

8. The three-way hat apparatus according to claim 1, wherein said 1st/linear-fastener means and cooperating said 2nd/linear-fastener means are a conventional extruded-type plastic-zipper having a coacting pull-cleat and dependent pull-tang.

9. The three-way hat apparatus according to claim 1, wherein said peripheral-brim is annular of substantially circular shape, and can be provided in different radial-measurements of approximately 2–5 inches, or 5–8 inches, or 8–10 inches; as measured from the head-band of central said cap.

10. The three-way hat apparatus according to claim 1, wherein said peripheral-brim includes a rear secondary/adjustment-gap arranged proximal said donning-aperture, whereby said peripheral-brim can thereby readily comply to user's manual pull-cord sizing-adjustment of said central-cap member.

11. The three-way hat apparatus according to claim 1, wherein said peripheral-brim includes a secondary/pull-cord threaded through a pull-sleeve arranged proximal said donning-aperture.

12. The three-way hat apparatus according to claim 1, wherein said peripheral-brim is shaped substantially in form of an eccentric-visor configuration, whereby predominate portion of said peripheral-brim is arranged forward of wearer's ears, thereby effectively shading wearer's face; or, wherein said peripheral-brim is shaped substantially in form of an eccentric-bill configuration, whereby predominant portion of said peripheral-brim is arranged aftward of wearer's ears; thereby effectively shading wearer's neck.

13. The three-way hat apparatus according to claim 1, wherein said peripheral-brim is made readily foldable via well known FIG. 8 collapsing procedure into a triad of contiguously tiered circular portions which is thus sized for convenient ease of stowing.

14. The three-way hat apparatus according to claim 1, wherein folded said peripheral-brim is conveniently placed within a stow-pocket formed into the uppermost underside of said central-cap member.

15. The three-way hat apparatus according to claim 14, wherein said central-cap member includes a hanger means whereby user may carry aggregate said central-cap and folded said d peripheral-brim hanging dependently down from their waist-belt during nonuse.

16. The three-way hat apparatus according to claim 14, wherein the perimeter of said peripheral-brim includes a continuous resilient-band, thereby serving to maintain a spring-back circular shape of said peripheral-brim as viewed from above.

17. The three-way hat apparatus according to claim 14, wherein said peripheral-brim member includes at least one radially deployed gathering-stay means, whereby said peripheral-brim can be manually pinched radially-inward proximal said central-cap; thereby enabling user to for example view more directly toward their forehead, or to merely attain a more stylish if rakish appearance.

18. The three-way hat apparatus according to claim 14, wherein said peripheral-brim member is fabricated from three to six substantially pie-shaped sections which each possess slightly more surface-area than required by a one-piece flat-pattern, thereby providing a slight overall gravity-droop appearance, found to be functionally more effective in shading wearer's head, as well as lending a more attractive relaxed appearance to the overall said peripheral-brim.

19. A non/gender-specific three-way hat convertible into independent modalities of usage; said hat comprising:

a first-modality central-cap means for entirely covering top of wearer's head without shading wearer's face or neck, the base-perimeter portion thereof comprising a circumferential headband with circular 1st/linear-fastener attachment means, plus provision of a normally concealed stow-pocket formed into crowned underside thereof for convenient storing of a peripheral-brim means;

a second-modality peripheral-brim means having a central donning-aperture as to thereby radially extend outward entirely around wearer's head and thereby shade wearer's face and neck, and including a circular 2nd/linear-fastener attachment means, and a continuous resilient-band means serving to maintain a spring-back circular shape of said peripheral-brim in plan-view, plus provision of plural gathering-stay means by which said peripheral-brim can be manually pinched radially-inward proximal said central-cap, at the front, at the rear, and at either right and left sides, thereby enabling wearer to selectively alter shading of said peripheral-brim in a azimuth manner while maintaining fixed longitudinal fore/aft orientation of said peripheral-brim;

a third-modality assembly, whereby both said first-modality central-cap means and said second-modality peripheral-brim means are combined via engagement of their respective said 1st and 2nd/linear-fastener attachment means, thereby forming a unitized and ostensibly conventional appearing complete brimmed-hat assembly when so desired;

a tote-modality wherein said central-cap member includes a utility retention-strap hanger means whereby user may opt to carry aggregate said central-cap with said peripheral-brim detachably folded and stowed therein said stow-pocket, while hanging dependently down from their waist-belt during nonuse.

20. A method of providing a non/gender-specific three-way hat convertible into independent modalities of usage; said method comprising:

providing a first-modality central-cap means for entirely covering top of wearer's head without shading wearer's face or neck, the base-perimeter portion thereof comprising a circumferential headband with circular 1st/linear-fastener attachment means;

providing a second-modality peripheral-brim means having a central donning-aperture as to thereby radially extend outward entirely around wearer's head and thereby shade wearer's face and neck, and including a circular; 2nd/linear-fastener attachment means, plus critical provision of a gathering-stay means by which to locally retract said peripheral-brim at the front, rear, and either side, thereby uniquely enabling wearer to selectively alter shading of said peripheral-brim in a azimuth manner while maintaining fixed longitudinal fore/aft orientation of said peripheral-brim;, providing a third-modality assembly, whereby both said first-modality central-cap means and said second-modality peripheral-brim means are combined via engagement of their respective said 1st and 2nd/linear-fastener attachment means, thereby forming a unitized and ostensibly conventional appearing complete brimmed-hat assembly when so desired.

* * * * *

UNITED STATES PATENT AND TRADEMARK OFFICE

CERTIFICATE OF CORRECTION

PATENT NO. : 6,484,323 B1
DATED : November 26, 2002
INVENTOR(S) : Phu H. Ly

It is certified that error appears in the above-identified patent and that said Letters Patent is hereby corrected as shown below:

Title page,
Item [12], "Pu" should read -- Ly --
Item [76], Inventor, "Ly Pu" should read -- Phu H. Ly --

Signed and Sealed this

Twenty-ninth Day of July, 2003

JAMES E. ROGAN
*Director of the United States Patent and Trademark Office*